US005476262A

United States Patent [19]

Bandiero

[11] Patent Number: 5,476,262

[45] Date of Patent: Dec. 19, 1995

[54] PUTTER TRAINER

[75] Inventor: Sol Bandiero, Monsey, N.Y.

[73] Assignee: Eugene Polanish, Hohokus, N.J.

[21] Appl. No.: 8,453

[22] Filed: Jan. 25, 1993

Related U.S. Application Data

[63] Continuation-in-part of Ser. No. 753,959, Sep. 3, 1991, abandoned.

[51] Int. Cl.[6] ..... A63B 69/36

[52] U.S. Cl. ..... 273/194 R; 273/186.2; 273/167 R

[58] Field of Search ..... 273/168, 193 R, 273/175, 171, 167 H, 67 A, 194 R, 186.2, 194 A, 77 R, 162 R

[56] References Cited

U.S. PATENT DOCUMENTS

| | | | |
|---|---|---|---|
| 1,877,820 | 9/1932 | Costello | 273/193 R |
| 2,094,766 | 10/1937 | Costello | 273/193 R |
| 3,194,564 | 7/1965 | Swan | 273/168 |
| 3,384,376 | 5/1968 | Greenlee | 273/193 R |
| 4,290,606 | 9/1981 | Maxwell | 273/67 A |
| 4,846,477 | 7/1989 | Phelan | 273/175 |
| 4,944,517 | 7/1990 | Redkey | 273/193 R |
| 4,962,927 | 10/1990 | Colucci | 273/167 H |
| 4,999,000 | 3/1991 | Finney | 273/171 |

*Primary Examiner*—Mark S. Graham
*Attorney, Agent, or Firm*—Philip Furgang

[57] ABSTRACT

A substantially "U" shaped head is provided in a golf training method with a pair of side walls spaced from each other, open at one end, and closed by an end wall at the other end. The space between the side walls is just wide enough to receive therebetween a golf ball and is approximately five to five and one-half inches deep. In a first embodiment, which is for putter training a cross-bar spans the side walls between the end wall and the opening. A handle or shaft extends up from the cross-bar at an angle, with respect thereto, and is sized to facilitate swinging of the head at a golf ball to practice putting. The material(s) from which the putter trainer are made are selected to simulate the weight size and feel of regulation putters and to produce audible "clicks" when striking the side walls and end wall. Lead tape may be disposed on side surfaces to balance the golf trainer.

1 Claim, 4 Drawing Sheets

PUTTER TRAINER

CROSS-REFERENCE TO RELATED APPLICATIONS

This application is a continuation-in-part application of my application Ser. No. 07/753,959 filed Sep. 3, 1991, abandoned under the title "Putter Trainer."

BACKGROUND OF THE INVENTION—FIELD OF APPLICATION

This invention relates to sports training equipment; and more particularly to equipment for practice and training for the game of golf.

BACKGROUND OF THE INVENTION—DESCRIPTION OF THE PRIOR ART

Golfing is both a recreational activity and a competitive sport. It is played by young and old, men and women, those who have physical problems and others who have none. It is a popular sport and pastime and its enthusiasts are generally most avid players and almost invariably always interested in improving their game.

Practice, while not always making perfect, then is an undertaking that a great many golfers not only also enjoy but quite often find to be necessary. It is not uncommon to see people at golf driving ranges practicing their swing and hoping to improve that drive since driving is what starts each hole and may be required even after the first stroke at each hole.

Putting and chipping are also practiced at length and people are seen on putting greens, in their backyards and even in their living rooms and offices assuming a stance, swinging their putters and paying careful attention to their follow-through. After all it has been said that one-third to one-half of the strokes of a typical golfer take place on the greens during a typical round of golf. There is no room for mistakes when putting the ball while on the green. A slight mis-hit of the ball will result in at least another stroke to sink the ball in the cup on the green. Most missed putts in the under 10 foot range are believed to be caused by improper follow-through.

A smooth accelerating stroke, alignment, confidence and a follow-through of about five inches are among the most important factors in proper putting strokes. You should putt with your shoulders and keep your wrists straight those same concepts also apply to chipping. There is a great need for a good short compact stroke and has always been a great need for a practice device for golfers to accomplish and fulfill that need.

Some prior art devices, such as shown for example in U.S. Pat. No. 2,084,901 granted on Jun. 22, 1937 to W. Eisenberg for "Putting Device" and in U.S. Pat. No. 2,084,902 granted on Jun. 22, 1937 to W. Eisenberg for "Putting Device," capture the golf putter in a trolley-like device that runs on rails of a track-like member to provide for training a golfer to putt properly. Such golf training devices are awkward and cumbersome and most surely present a burden if the golf enthusiast wants to practice on a golf green and, therefore, has to cart the device to such golf green. If this type of device became dirty or rusty and/or if the wheels of the trolley-like club retainer do not properly rotate on their respective axis then the device will not only not help the golfer, but it will interfere with their practice and training.

J. E. Donaldson in his U.S. Pat. No. 3,471,155 granted to him on Oct. 7, 1969 for "Golf Training Apparatus" also shows and describes a device which retains a golf putter in a trolley-like device but one which is horizontally disposed instead of curved like the Eisenberg devices discussed earlier. The Donaldson device, however, suffers from deficiencies and characteristics very similar to the Eisenberg devices. It requires rolling wheels and guide wheels which are confined for movement in a guide track. It also appears to be cumbersome and not easily portable and will become a burden instead of a help to the golfer if the tracks clog with dirt or rust and/or if the wheels do not roll smoothly.

Other prior art devices, such as those shown by way of example in U.S. Pat. No. 3,885,796 granted on May 27, 1975 to V. W. King for "Golf Putting Practice Apparatus" and in U.S. Pat. No. 4,437,669 granted on Mar. 20, 1984 to D. T. Pelz for "Golf Practice Putting Track," merely provide guide tracks for confining a golf putter against side-to-side motion. These devices further add to the golfer's paraphernalia that must be carried to and about a practice putting green and do not necessarily readily and easily facilitate practice of a follow-through of a desired length or distance. United Kingdom Patent Application Number 2,020,983A of R. C. Nash, et al filed 20 Jun. 1979 for "Golf Training Apparatus" also shows a track-like device but one which requires a special putter training club as well as further increasing the bulk and weight of practice and play equipment the golfers must take with them.

A golf training device such as shown and described in U.S. Pat. No. 3,194,565 granted on Jul. 13, 1965 to J. B. Schroer for "Indicator Device Actuable By The Movement Of A Golf Club Head Between Two Spaced Strips On A Mat" merely provides for ringing of different bells depending upon which manner and direction the golfers stroke strays from a proper swing; while U.S. Pat. No. 4,877,251 granted on Oct. 31, 1989 to W. Faust for "Putting Device" provides a golf novelty device with a rod attached at one end to a putter head and at its other to a funnel-like guide tube. It appears that the awkward and unbalanced device of Faust would most probably interfere with practicing a proper swing and follow-through in golf putting practice.

F. Scelzo, Jr. in his U.S. Pat. No. 2,894,755 granted to him on Jul. 14, 1959 for "Golf Practice Device" also provides a track-like guide device with its own window shade like piece of cloth for supporting the golf ball and its own simulated hole or cup. but all the adjustable and relatively movable parts in the Scelzo device merely add to its cost, complexity and weight and as such detract from its usefulness as a golf putting training aid. T. H. Watkins on the other hand, in his U.S. Pat. No. 5,011,153 granted on Apr. 30, 1991 for "Golf Putting Aid And Teaching Device" utilizes rubber bands to attach a putter to a "U" shaped bracket-like device. The putter head and its shaft in the Watkins device are, however, both located at the same location in the rear of the device and do not urge the golfer into a proper follow-through.

U.S. Pat. No. 4,999,000 issued on Mar. 12, 1991 to C. D. Finney for "Golf Clubhead With A High Polar Moment Of Inertia" and U.S. Pat. No. 4,962,927 issued on Oct. 16, 1990 to N. Colucci for "Putter Head" show and describe gold putters but do not provide putters suitable for training purposes; while U.S. Pat. No. 4,290,606 issued on Sep. 22, 1981 to T. J. Maxwell for "Nonpredictable Game Projectile" provides a cubicle golf like projectile and various forms of impelling devices none of which are suitable for training a golfer.

A golf practice club is shown and described in U.S. Pat.

No. 4,944,517 issued on Jul. 31, 1990 to R. H. Redkey for "Golf Practice Club" but the Redkey device does not include a ball striking surface and as such may not provide a realistic practice club. On the other hand U.S. Pat. No. 1,877,820 issued to H. O. Costello on Sep. 20, 1932 for "Game Appliance" and U.S. Pat. No. 2,094,766 issued on Oct. 5, 1937 to H. O. Costello also for "Game Appliance" show devices which capture the golf ball instead of striking the golf ball and, as such, also do not provide realistic golf practice devices.

A. M. Greenlee in his U.S. Pat. No. 3,384,376 issued on May 21, 1968 for "Practice Golf Putter" merely provides a pin projecting from a putter head with two guides spaced from the pin by distances providing a separation therebetween which is significantly in excess of the size of a standard golf ball. As such, the Greenlee device does not provide for realistic golf training and practice. L. S. Swan in his U.S. Pat. No. 3,194,564 issued on Jul. 13, 1965 for "Practice Golf Club" places his golf club head and shaft in the same plane which does not provide for optimum practice; while H. A. Phelan in his U.S. Pat. No. 4,846,477 issued on Jul. 11, 1989 for "Golf Putter" aligns his shaft with the surfaces that are to strike the golf ball thus also not providing for optimum practice.

SUMMARY OF THE INVENTION

It is therefore an object of this invention to provide new and novel golf putter and chipper training devices.

It is another object of this invention to provide new and novel golf putter and chipper trainers which facilitate practice and training for golfers to improve their putting and chipping strokes.

It is still another object of this invention to provide new and novel golf putter and chipper trainers which facilitate training and practice for a better follow-through in one's golf stroke.

It is yet still another object of this invention to provide new and novel golf putter and chipper trainers which facilitate training and practice for smooth accelerating strokes.

It is a further object of this invention to provide new and novel golf putter and chipper trainers which facilitate and promote training and practice in alignment of the golf ball and golf club head when taking a golf stroke.

It is yet a further object of this invention to provide new and novel golf putter and chipper trainers which facilitate and promote confidence in one's own golf club and its use in playing golf.

Other object, features and advantages of the invention in its details of construction and arrangement of parts will be seen from the following description of the preferred embodiments when considered with the drawing and from the appended claims.

DESCRIPTION OF THE PREFERRED EMBODIMENT

Figure 1:
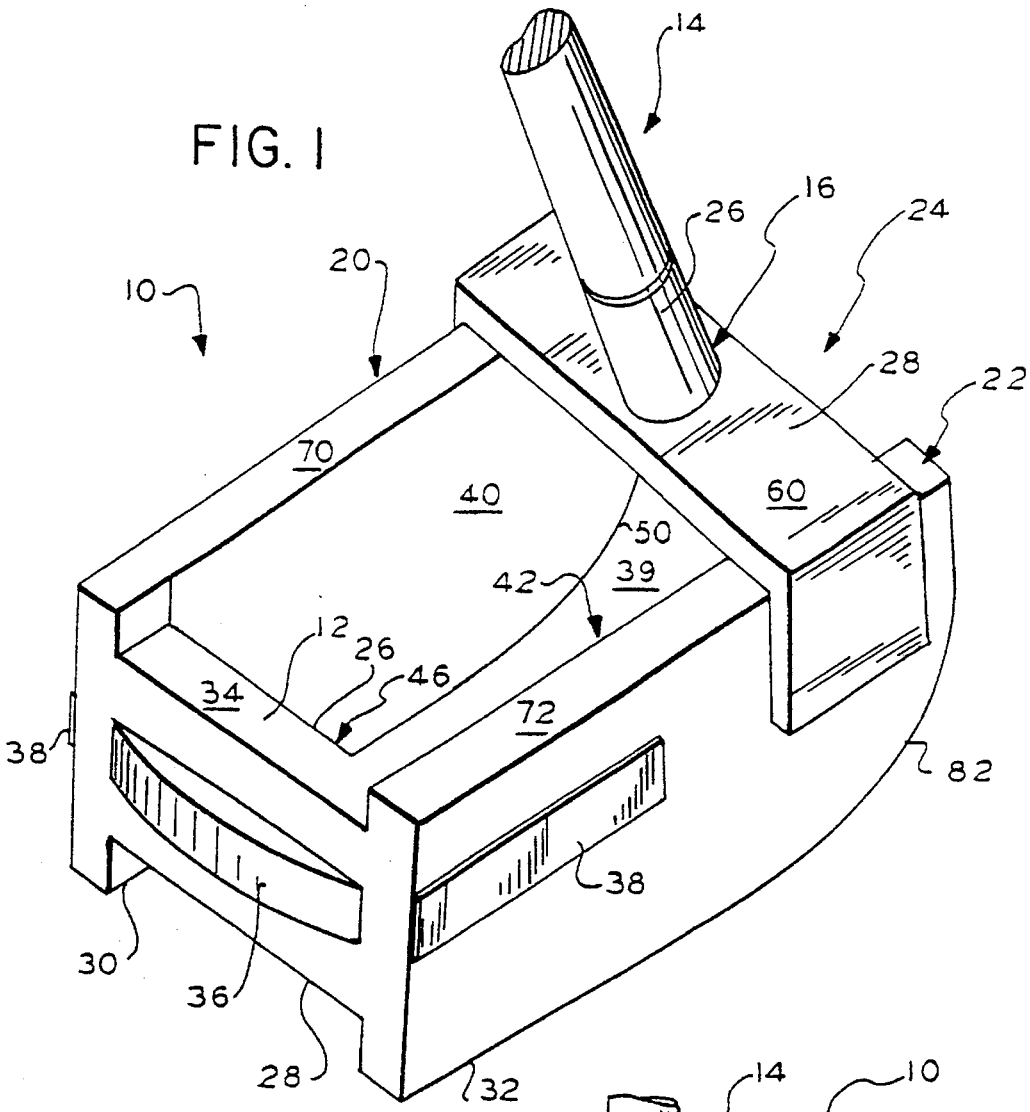
FIG. 1 is a perspective showing of a golf putter trainer, incorporating the instant invention, with the handle for the device cut short to better show details thereof.
Figure 3:
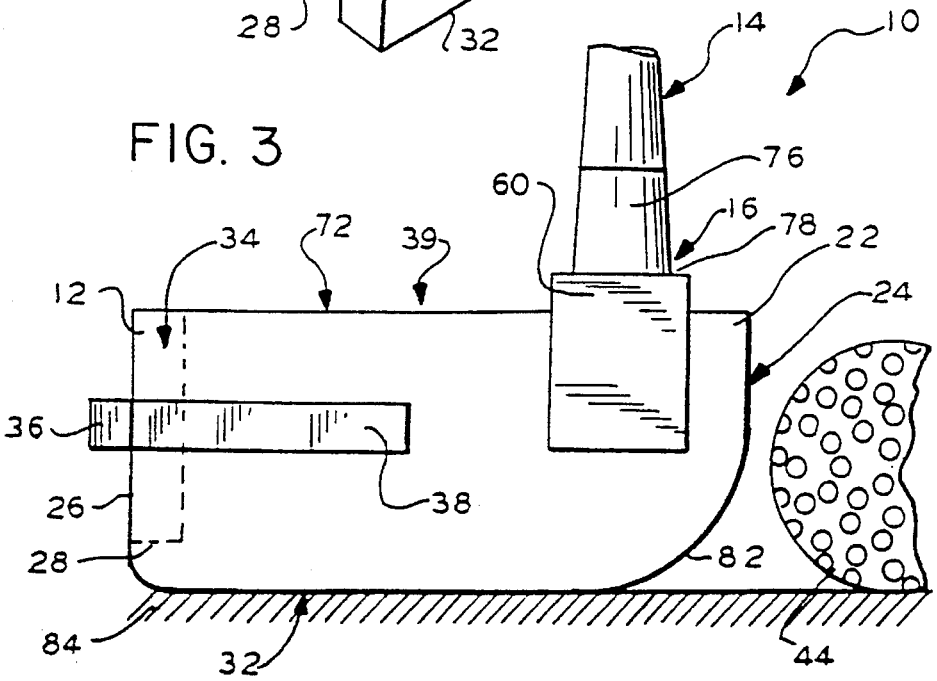
FIG. 3 is a side elevational view of the golf putter trainer of FIG. 1.
Figure 2:
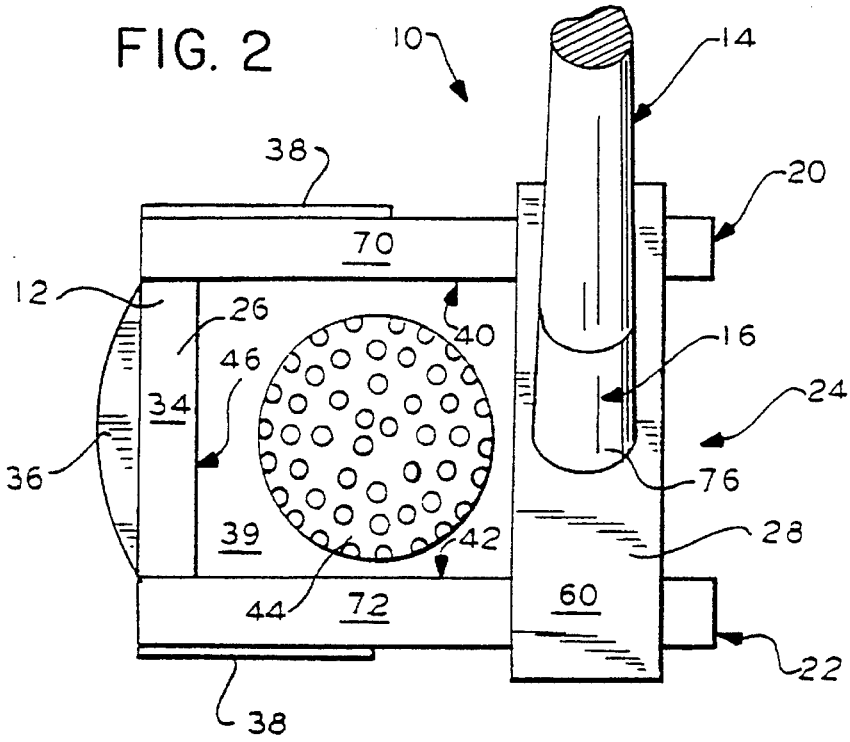
FIG. 2 is a plan view of the golf putter trainer of FIG. 1.

With reference to FIGS. 1 through 3 there is generally shown at 10 a golf putter trainer incorporating the instant invention. Putter trainer 10 includes a head 12 and a handle 14 that connects to head 12 at a connection place 16.

Head 12 is substantially "U" shaped and includes a pair of spaced side walls 20, 22 open at their front end at 24 and spanned at their other ends by a rear wall 26. A lower surface 28, of rear wall 26, is disposed at a higher disposition than lower surfaces 30, 32 of side walls 20, 22 respectively. In addition, an upper surface 34 of rear wall 26 is disposed at a lower disposition than respective upper surfaces of side walls 20, 22. A weight 36 of suitable material is secured to a rear surface 37 of rear wall 26 to be centrally located thereon and strips 38 of lead tape (or tape of other suitable material for the purpose) are secured on outer surfaces of side walls 20, 22 extending in from rear wall 26 as required to balance putter trainer 10. The aforedescribed construction for rear wall 26, the disposition of weight 36 and the amount of weight added thereby are selected to provide a feel, and weight for putter trainer 10 similar to that of a regulation putter and a sound, when putter trainer 10 strikes a golf ball similar to that experience by one when playing golf. A ball space 39 is defined between side walls 20, 22 and rear wall 26. The width of space 39 between inner surfaces 40, 42 (FIGS. 1 and 2) respectively of side wall 20, 22 is just somewhat larger than the diameter of a standard golf ball 44-say about two and one-half inches but can be selected to be in a range between two and one-half to three and one-half inches; while the length of space 39 from its front end at 24 to an inner surface 46 of rear wall 26 is about five to five and one-half inches, but can be selected to be in a range between three to eight inches.

A handle support cross-bar 60 spans upper surfaces 70, 72 of side walls 20, 22 respectively and is either formed integral therewith or is otherwise conventionally secured thereto. A handle connector 76 extends up from cross-bar 60 at a predetermined angle to an upper surface 78 thereof at connection place 16 and is sized, configured and otherwise formed to receive handle 14. If desired, handle 14 and handle connector 76 can be integrally formed as one piece and suitably secured to cross-bar 60 or they may be formed integral with cross-bar 60. Cross-bar 60 may be connected to the rest of head 12 at side walls 20, 22 by suitable means such as adhesive, threaded members or the like or it may be formed integral therewith.

Front lower corners 80, 82 (FIG. 1) of side walls 20, 22 respectively are curved to permit smooth movement of putter trainer over a training surface 84 (FIG. 3) such as grass or a carpet in one's home or office.

Putter trainer 10, its head 12 and handle 14 may be formed from suitable materials normally utilized to manufacture golf clubs and particularly golf putters; or, if, desired, a combination of such materials.

When utilizing golf putter trainer 10 to practice putting and/or chipping one place a golf ball, such as golf ball 44 (FIG. 2) upon an appropriate surface 84 such as grass, carpet or the like. Putter trainer 10 is then properly grasped and the user assumes the proper stance. Putter trainer 10 is then swung so that its side walls 20, 22 span golf ball 44 and so that golf ball 44 is struck with the proper amount of force by inner surface 46 of rear wall 26 to putt ball 44 forward and back out through opening 24.

The disposition of cross-bar 60 spaced forward of rear wall 26 (i.e. between rear wall 26 and opening 24 and the respective spacing between side walls 20, 22) and the depth of rear wall 26 facilitate practice to attain an appropriate follow-through of preferably about five to five and one-half inches when putter trainer 10 is so sized and otherwise depending upon the depth of putter trainer 10. If the side-walls are longer, the following through is longer. The disposition of cross-bar 60 further places handle or shaft 14 in front of rear wall 26 forcing the user to swing past shaft 14 in order to strike ball 44-another desired training and practice aspect of this invention. The width of space 39 is selected to provide a trainer for straight strokes and follow-through of proper length since the relative sizing of the width of space 39 and of golf ball 44 is such that if the golfer pulls back too far they will miss getting ball 44 into the rectangle of space 39 so as to hit surface 46 and then out without hitting surfaces 40, 42. The rectangular shape of space 39 creates an elongated target line between ball 44, the blade of the golf club which is surface 46 and the target (i.e. whatever hole ball 44 is to be sunk into). This tends to help to align putting, shorten backswing and lengthen follow-through.

Putter trainer 10 may be constructed and weighted to be heavier than a usual putter and as such its use would be considered by some to build confidence in the use of one's own putter.

Figure 4:
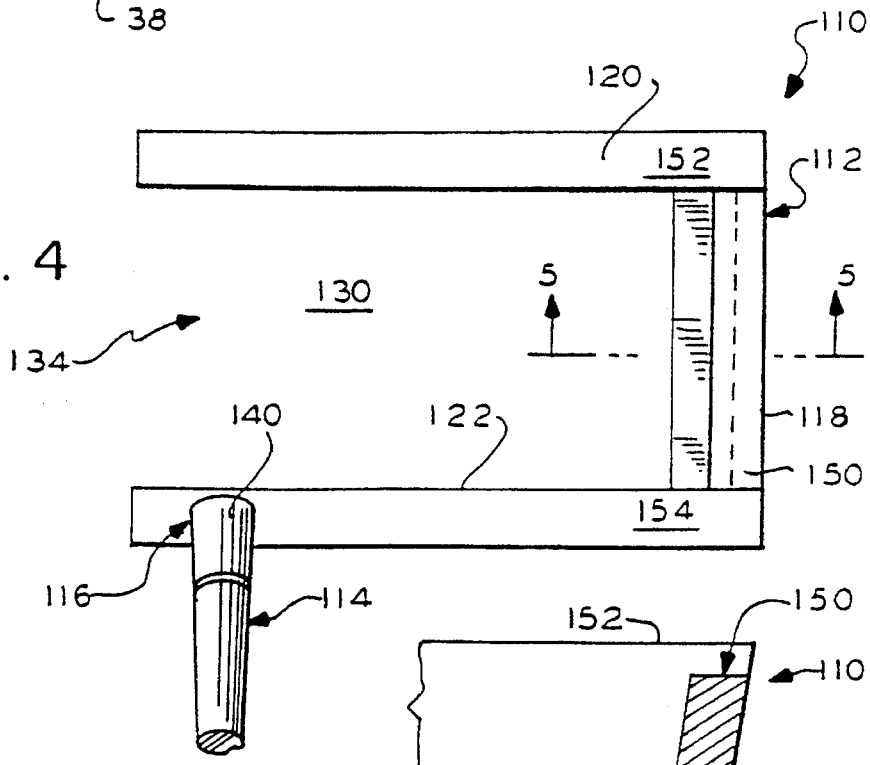
FIG. 4 is a plan view of a golf chipper trainer, incorporating the instant invention, with the handle for the device cut short to better show details thereof.
Figure 5:
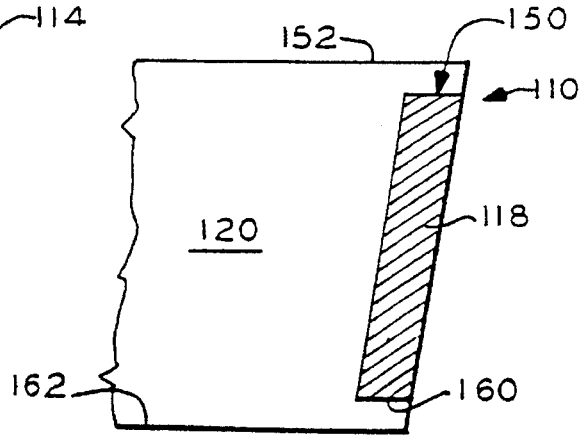
FIG. 5 is a sectional view, in elevation, taken on line 5—5 of FIG. 4.

FIGS. 4 and 5 show a chipper trainer 110 incorporating the instant invention and which, like putter trainer 10 of FIGS. 1–3, includes a substantially or generally "U" shaped head 112 (FIG. 4) and a handle 114 connected thereto at a connection place 116. Head 112 includes a rear wall 118 which spans and connects a pair of spaced side walls 120, 122 to define therebetween a ball space 130. "U" shaped head 112 is substantially rectangular and open at its front at 134. The respective sizes for the length and width of space 130 are selected similar to the sizing of space 39 of the FIGS. 1–3 embodiment as are the materials for the construction of head 112 and handle 114.

It should be noted, however, that handle 114 and its connector 140 are only secured to side wall 122 at a top surface 142 thereof and proximate front end 134. The connection of handle 114 and its connector 140 are such that handle 114 extends up at an angle appropriate for a chipper.

It should be further noted that rear wall 118 comprises the blade for chipper trainer 110 and like conventional blades for chippers is disposed at an angle, as shown in FIG. 5, that extends up and to the right. An upper surface 150 of rear wall or blade 118 is disposed somewhat lower than upper surfaces 152, 154 of side walls 120, 122 respectively; while a lower surface 160 of rear wall or blade 118 is disposed above the level of lower surfaces 162, 164 of side walls 120, 122 respectively.

Chipper trainer 110 is otherwise constructed similarly to putter trainer 10 but without a cross-bar spanning side walls 120, 122 proximate front end 134 thereof since that would obstruct the flight path for a golf ball struck by blade 118 when chipper trainer 110 is being used. Chipper trainer 110, if desired, could be constructed and weighted and otherwise similar to the construction of FIGS. 1–3 to be similar to a normal chipper or to be heavier than a normal chipper.

Figure 6:
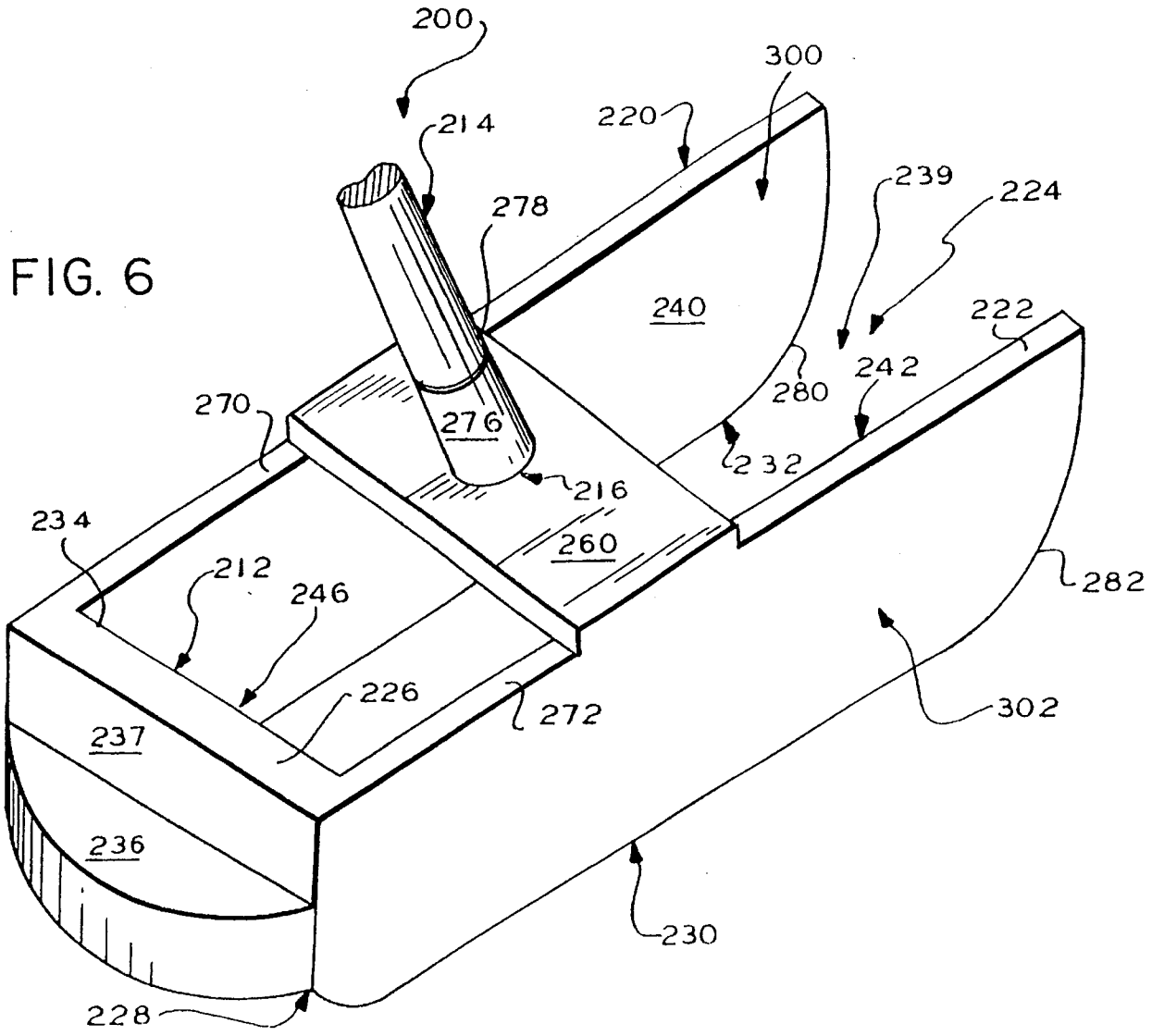
FIG. 6 is a perspective showing of an alternative golf putter trainer incorporating the instant invention with the handle cut short to better show details thereof.

With reference to FIG. 6 there is generally shown at 200 a golf putter trainer incorporating the instant invention. Putter trainer 200 includes a head 212 and a handle 214 that connects to head 212 at a connection place 216.

Head 212 is substantially "U" shaped and includes a pair of spaced side walls 220, 222 open at their front end at 224 and spanned at their other ends by a rear or end wall 226. A lower surface 228 of rear wall 226 is disposed at a higher disposition than lower surfaces 230, 232 of side walls 220, 222 respectively. An upper surface 234 of rear wall 226 is, however, disposed at the same levels as the respective upper surfaces of side walls 220, 222 and in that respect differs from the FIGS. 1 and 2 embodiment.

A weight 236 which may be of the same material as putter trainer 200 projects from a rear surface 237 of rear wall 226 and is centrally located thereon. Strips (not shown) of lead tape or tape of other suitable material for the purpose may be secured to outer surfaces of side walls 220, 222 extending in from rear wall 226 if required to balance putter trainer 200 as described for the FIGS. 1 and 2 embodiment. The aforedescribed construction for rear wall 226, the disposition of weight 236 and the amount of weight, if any, added thereby are selected to provide a feel, and weight for putter trainer 200 similar to that of a regulation putter and a sound, when putter trainer 200 strikes a golf ball similar to that experienced by one when playing golf.

A ball space 239 is defined between side walls 220, 222 and rear wall 226. The width of space 239 between inner surfaces 240, 242 respectively of side walls 220, 222 is just somewhat larger than the diameter of a standard golf ball-say about two and one-half inches but can be selected to be in a range between two and one-half to three and one-half inches; while the length of space 239 from an inner surface 246 of rear wall 226 to the front edge of a handle support cross-piece 260 is about five to five and one-half inches, but can be selected to be in a range between three to eight inches.

Handle support cross-piece 260 spans upper surfaces 270, 272 of side walls 220, 222 respectively and is formed integral therewith. A handle connector 276 extends up from cross-piece 260 at a predetermined angle to an upper surface 278 thereof at connection place 216 and is sized, configured and otherwise formed to receive handle 214. If desired, handle 214 and handle connector 276 can be integrally formed as one piece and suitably secured to cross-piece 260 or they may be formed integral with cross-piece 260.

Front lower corners 280, 282 of side walls 220, 222 respectively are curved to permit smooth movement of putter trainer 200 over a training surface such as grass or a carpet in one's home or office.

It should be noted that side wall 220, 222 extend forward from the front edge of cross-piece 260 a distance which is relatively greater than that shown for putter trainer 10 of FIGS. 1 and 2. The addition of these side wall extensions 300, 302 serve to further train the user for an accurate swing and follow-through. Extensions 300, 302 may extend from cross-piece 260 by up to eight inches.

Putter trainer 200 its head 212 and handle 214 may be formed from suitable materials normally utilized to manufacture golf clubs and particularly golf putters; or if, desired, a combination of such materials.

When utilizing golf putter trainer 200 to practice putting and/or chipping one places a golf ball upon an appropriate surface such as grass, carpet or the like. Putter trainer 200 is then properly grasped and the user assumes the proper stance. Putter trainer 200 is then swung so that its side walls 220, 222 span the golf ball and so that the golf ball is struck with the proper amount of force by inner surface 246 or rear wall 226 to putt the ball forward and back out through opening 224.

The disposition of cross-piece 260 spaced forward of rear wall 226 (i.e. between rear wall 226 and opening 224) the length of side walls 220, 222 including extensions 300, 302 thereof and the respective spacing between side walls 220, 222 and the depth of rear wall 226 facilitate practice to attain an appropriate follow-through of about twelve to fourteen inches when putter trainer 200 is so sized and otherwise depending upon the depth of putter trainer 200. The disposition of cross-piece 260 further places handle or shaft 214 in front of rear wall 226 but behind opening 224 forcing the user to swing past shaft 214 in order to strike the ball-another desired training and practice aspect of this invention. The width of space 239, as well as its length, is selected to provide a trainer for straight strokes and follow-through of proper length since the relative sizing of the width of space 239 and of the golf ball is such that if the golfer pulls back too far they will miss getting the ball into the elongated rectangle of space 239 so as to hit surface 246 and then out without hitting surfaces 240, 242. The rectangular shape of space 239 creates an elongated target line between the ball, the blade of the golf club which is surface 246 and the target (i.e. whatever hole the ball is to be sunk into). This tends to help to align putting, shorten backswing and lengthen follow-through.

Putter trainer 200 may be constructed and weighted to be heavier than a usual putter and as such its use would be considered by some to help build confidence in the use of one's own putter.

Figure 7:
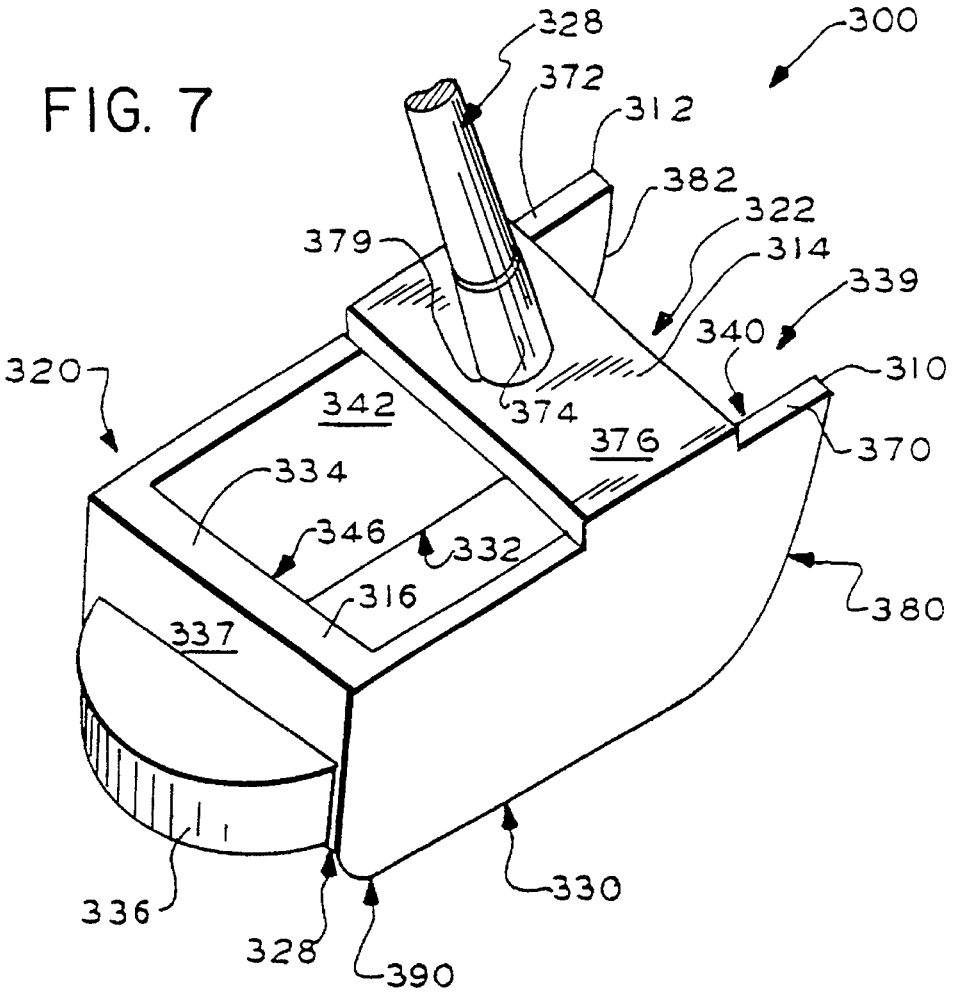
FIG. 7 is a perspective showing of another alternative golf putter trainer incorporating the instant invention with the handle cut short to better show details thereof.
Figure 8:
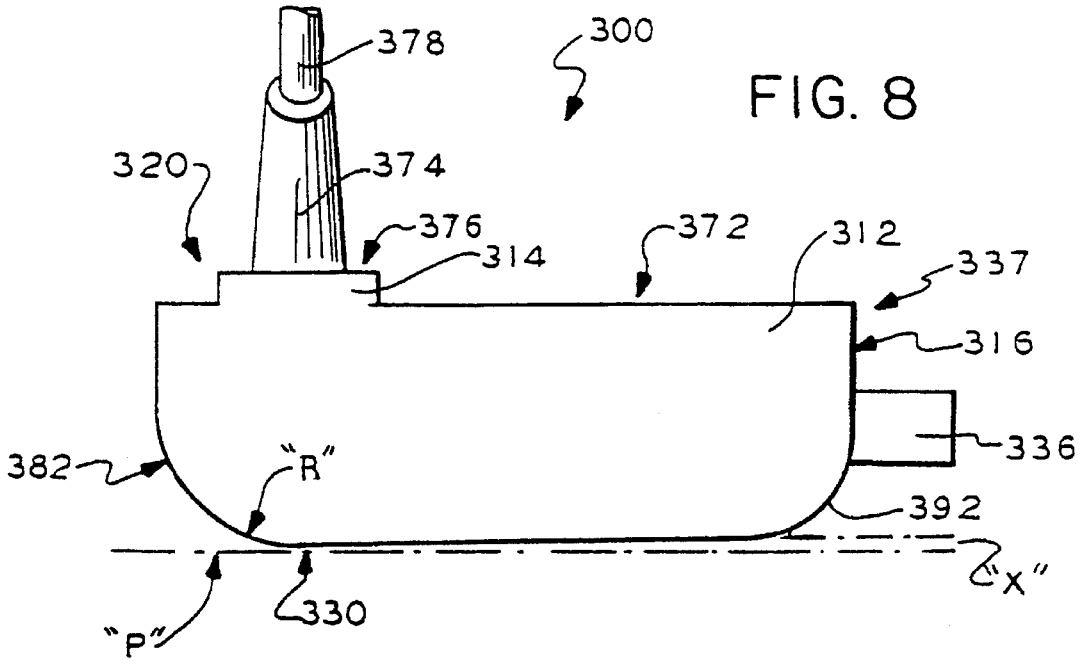
FIG. 8 is a side elevational view of the golf putter trainer of FIG. 7.

FIGS. 7 and 8 show an alternative and preferred construction for a putter trainer 300 with its side walls 310, 312 formed similar to that of the putter trainer of FIG. 6 but with the length thereof similar to that of the putter trainer of FIGS. 1 and 2 i.e., so that walls 310, 312 terminate only a short distance forward of a cross-piece 314 that spans side walls 310, 312.

Side walls 310, 312 are spanned at one of their ends by a rear or end wall 316 (FIG. 7) and together with cross-bar 314 form a substantially "U" shaped head 320 for putter trainer 300 that is open at 322 between side walls 310, 312. A lower surface 328 of rear wall 316 is disposed at a higher disposition than lower surfaces 330, 332 of side walls 310, 312 respectively. An upper surface 334 of rear wall 316 is, however, disposed at the same levels as the respective upper surfaces of side walls 310, 312.

A weight 336 which is of the same material as putter trainer 300 projects from a rear surface 337 of rear wall 316 and may be centrally located thereon. The aforedescribed construction for rear wall 316, the disposition of weight 336 and the amount of weight, if any, included therein are selected to provide a feel, and weight for putter trainer 300 similar to that of a regulation putter and a sound, when putter trainer 300 strikes a golf ball similar to that experienced by one when playing golf.

A ball space 339 is defined between side walls 310, 312 and rear wall 316. The width of space 339 between inner surfaces 340, 342 (FIG. 7) respectively of side walls 310, 312 is just somewhat larger than the diameter of a standard golf ball-say about two and one-half inches but can be selected to be in a range between two and one-half to three and one-half inches; while the length of space 339 from an inner surface 346 or rear wall 316 to the front edge of handle support cross-piece 314 is about five to five and one-half inches, but can be selected to be in a range between three to eight inches.

Handle support cross-piece 314 spans upper surfaces 370, 372 of side walls 310, 312 respectively and is formed integral therewith. A handle connector 374 extends up from cross-piece 314 at a predetermined angle to an upper surface 376 thereof at a connection place 377 and is sized, configured and otherwise formed to receive a handle 378. If desired, handle 378 and handle connector 374 can be integrally formed as one piece and suitably secured to cross-piece 314 or they may be formed integral with cross-piece 314.

Front lower corners 380, 382 of side walls 310, 312 respectively are curved to permit smooth movement of putter trainer 300 over a training surface such as grass or a carpet in one's home or office.

It should be noted that lower surfaces 330, 332 of side walls 310, 312 respectively extend upwardly at an incline from a reference or bottom point "R" (only shown for side wall 312 in FIG. 8) towards rear wall 316 terminating at a curved portion 390 (FIG. 7), 392 (FIG. 8) respectively. The incline angle "X" at which lower surfaces 330, 332 meet reference "R" and incline therefrom may be between "O" degrees to 24 degrees to a horizontal plane "P" (FIG. 8) that extends through reference "R"; with an incline "X" angle close to 1 degree or 0.97 degrees preferred. As incline angle "X" gets larger the vertical size of rear wall 316 may have to be reduced and the disposition of weight 336 extending from rear wall 316 may have to be relocated; however, rear wall 316 is to be sized so as not to be smaller than one inch.

Putter trainer 300 is sized, weighted and constructed to simulate the weight, size and feel of an ordinary putter and is used in a manner similar to that described above for the embodiment of FIGS. 1—3, FIGS. 4 and 5 and FIG. 6.

The trainer forces the hands of the player to move forward at least five (5) to eight (8) inches past the location of the ball-striking area of a normal putter or chipper. This requires the user to complete a follow through which is exaggerated by the distance the ball striking surface is offset behind the shaft to thereby train the user to perform a proper follow through with a standard putter or chipper.

The object to be achieved by the putter trainers hereinabove described is to force the user to make a perfect straight follow-through. Thus the slightest inside to outside, outside to inside, or other twisting will result in the golf ball striking an inner surface of the side walls before striking the inner surface of the rear or end wall. Such a "double-hit" will produce a clearly audible "click-clock" sound loud enough to be heard by the user and telling the user that they have not produced the intended straight follow-through.

The material selected for the described putter (chipper) trainers is one that will produce the desired and audible "click-click" if there is a double-hit or a single "click" if the follow-through is as desired. The material for the putter trainers is also such that even the slightest double-hit is transmitted through the shaft handle to the user's finger tips because the vibration in the head is sent to the shaft.

From the above description, it will thus be seen that there have been provided new and novel putter and chipper trainers and practice devices which are relatively simple in construction and use and which facilitate training in follow-through, smooth acceleration and alignment and build confidence in putting and/or chipping of golf balls.

It is understood that although I have shown the preferred embodiments of my invention that various modifications may be made in their details without departing from the spirit as comprehended by the following claims.

What is claimed is:

1. The method of practicing or training for an aspect of golf; comprising:

(a) providing a training golf club for a person to swing at a golf ball in practicing to hit the golf ball for the aspect of golf;

(b) forming said training golf club with a golf ball striking surface;

(c) providing spaced side walls extending from spaced positions of said golf ball striking surface in a first predetermined direction and so to form with said ball striking surface a club head and so as to define between said spaced side walls and said golf ball striking surface a space of a size and configuration to receive and permit passage therethrough of a golf ball;

(d) providing an opening into said space at ends of said spaced side walls spaced from said golf ball striking surface;

(e) providing a handle for said club head of a size and configuration that will permit a golfer to swing said club head at a golf ball; and (f) providing a cross-piece spanning said spaced side walls and connected thereto at top edges thereof proximate said opening and connecting said handle to said cross-piece to extend upwardly therefrom at a predetermined angle;

(g) connecting said handle to said cross-piece at an acute angle thereto;

(h) practicing an aspect of golf by swinging said handle to move said club head in a path so that as said club head encounters a golf ball the golf ball enters said space, passes between said side walls, is struck by said golf ball striking surface and then moves between said spaced side walls out of said opening.

* * * * *